US007017710B2

(12) United States Patent
Booysen et al.

(10) Patent No.: US 7,017,710 B2
(45) Date of Patent: Mar. 28, 2006

(54) SCAFFOLDING

(76) Inventors: Pieter Wouter Booysen, 30 Lebombo Street, Secunda, 2302 (ZA); Michael Walter Seitz, 2030 Albion Rd., Midlothian, VA (US) 23113

( * ) Notice: Subject to any disclaimer, the term of this patent is extended or adjusted under 35 U.S.C. 154(b) by 0 days.

(21) Appl. No.: 10/240,871

(22) PCT Filed: Apr. 3, 2001

(86) PCT No.: PCT/IB01/00554

§ 371 (c)(1),
(2), (4) Date: Mar. 13, 2003

(87) PCT Pub. No.: WO01/75248

PCT Pub. Date: Oct. 11, 2001

(65) Prior Publication Data

US 2003/0175070 A1 Sep. 18, 2003

(30) Foreign Application Priority Data

Apr. 4, 2000 (ZA) ..... 2000/1681

(51) Int. Cl.
*E04G 1/14* (2006.01)

(52) U.S. Cl. ..... 182/178.1; 182/151

(58) Field of Classification Search ..... 182/178.1, 182/179.1, 186.6, 186.7, 222, 151; 403/49
See application file for complete search history.

(56) References Cited

U.S. PATENT DOCUMENTS

| | | | | |
|---|---|---|---|---|
| 4,497,271 | A * | 2/1985 | Gloystein | 114/75 |
| 4,821,844 | A * | 4/1989 | Huffman et al. | 182/186.9 |
| 5,217,314 | A * | 6/1993 | Perruelle | 403/49 |
| 6,450,291 | B1 * | 9/2002 | Ono | 182/178.1 |

FOREIGN PATENT DOCUMENTS

| | | | |
|---|---|---|---|
| EP | 117643 | A2 * | 9/1984 |
| GB | 2006911 | A * | 5/1979 |

* cited by examiner

*Primary Examiner*—Alvin Chin-Shue
(74) *Attorney, Agent, or Firm*—Pauley Petersen & Erickson

(57) ABSTRACT

A scaffolding element used in conjunction with an upright alignment member, such as a pole. The scaffolding element having at least one connector member at each end portion thereof. The opposing connector members are oriented transversely relative to one another, such that the connector members of adjacent scaffolding elements can interlock at right angles to one another, forming a structure of interlocking scaffolding elements. The connector members can be formed from a metal plate or can be a casting, for example.

3 Claims, 7 Drawing Sheets

C
10
12
26
56
26
54
B
38
12
18·2
26
10
18·2
54
A
26
26
56
26

B
38
18.2
12
18
34
56
26
54
26
D
32
10
18.2
36
26
18
54
26
26
56
A
26

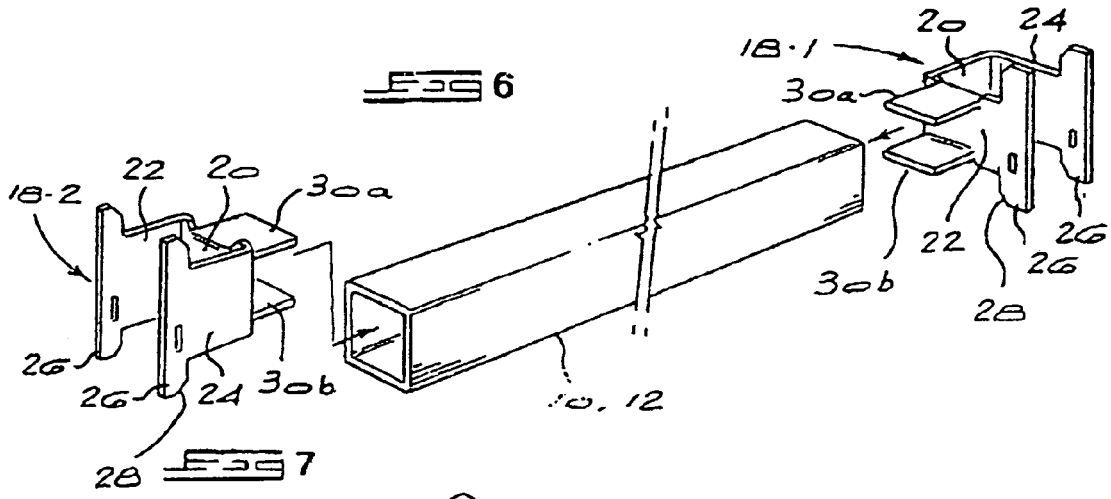
FIG 6
FIG 7
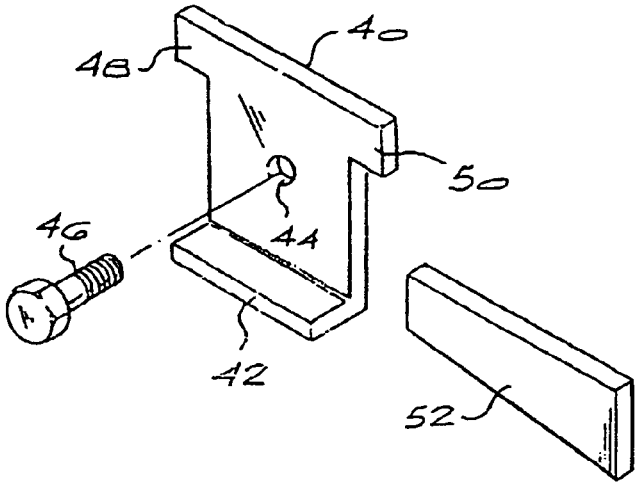
FIG 8
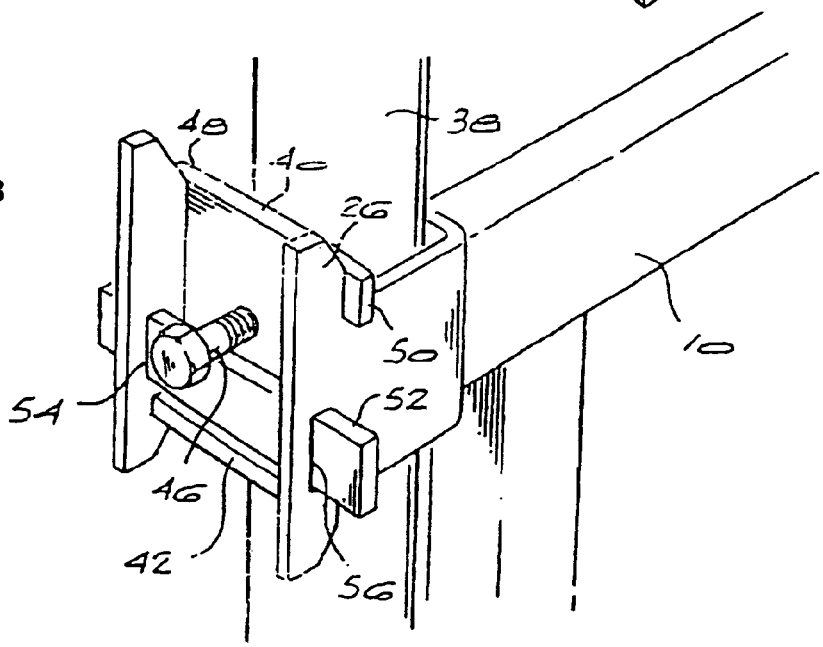

FIG 15a
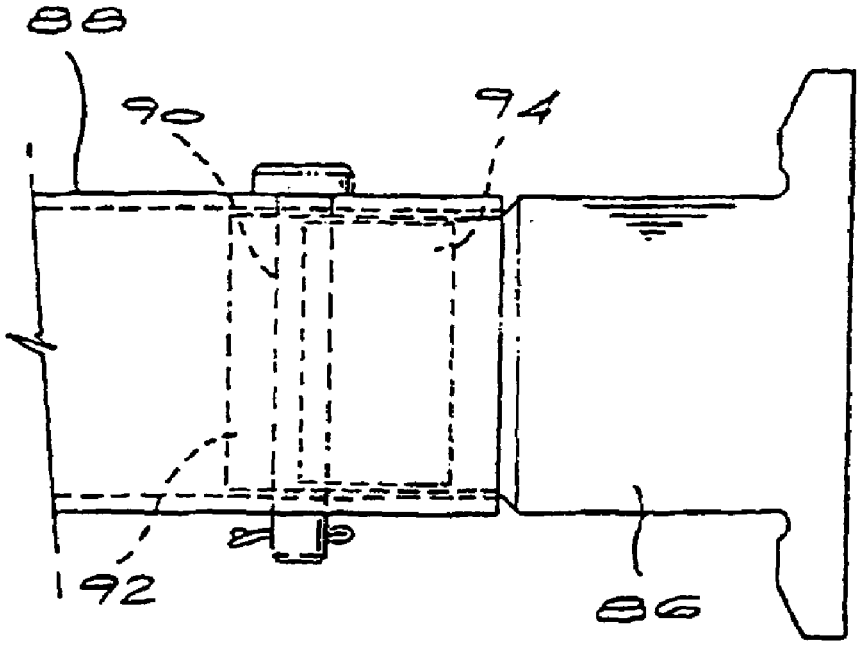
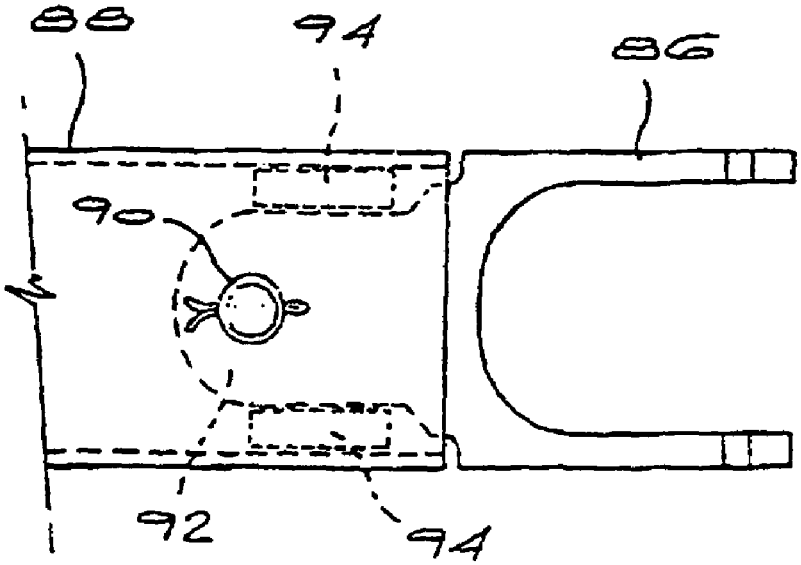
FIG 15b

SCAFFOLDING

BACKGROUND OF THE INVENTION

THIS invention relates to scaffolding which can be used, for example, in construction and maintenance applications.

Various kinds of scaffolding, including system scaffolding and frame scaffolding, are well known. System scaffolding is relatively versatile, but is time and labour intensive to erect, while frame scaffolding can be easier to erect but the components thereof are bulky and difficult to handle, and the versatility of such scaffolding is relatively limited.

SUMMARY OF THE INVENTION

According to the invention a scaffolding element for use in conjunction with an upright alignment member comprises a frame having opposed ends, with at least one connector member at each end, each connector member comprising a generally U-shaped bracket having first and second limbs sized to fit around the upright alignment member on opposite sides thereof, at least one of the first and second limbs having a transversely extending locking formation thereon for engagement with a locking formation of a connector member of another scaffolding element.

The scaffolding element may be a generally rectangular frame having opposed pairs of connector members at respective ends thereof.

Preferably, the connector members at a first end of the frame are oriented transversely relative to the connector members at a second, opposed end of the frame, so that the connector members of the adjacent frames can interlock.

The connector members are preferably shaped to interlock with adjacent connector members at right angles to one another, thereby creating a structure of interlocking scaffolding elements.

The frame members may be formed from rectangular tubing, the connector members each having a locating formation which is receivable in an open end of a frame member.

In one embodiment, the connector member is formed from metal plate, with the locating formation comprising at least one limb bent from the plate.

In this case, the connector member may be secured to the frame member by welding, bolting or riveting, for example.

In another embodiment, the connector member is a metal casting, with the locating formation comprising a head formed at one end of the connector member.

In this embodiment, the connector member may be secured to the frame member by crimping or indenting the frame member about the head, for example.

Preferably, each of the first and second limbs of the connector member is formed with a pair of outwardly extending lugs at least one of which interlocks with a lug of a mating connector member in use.

The connector members may be mounted resiliently to the frame, to accommodate misalignment between adjacent interlocking scaffolding elements.

BRIEF DESCRIPTION OF THE DRAWINGS

FIG. 6 is an exploded view of an elongate frame member of the scaffolding element of FIG. 1, showing the construction of connector members thereof;

FIG. 7 shows locking components for use with the connector members shown in FIGS. 1 to 6;

FIG. 8 shows a connector member locked in position on an upright support using the locking members of FIG. 7;

FIGS. 15*a* & 15*b* are an elevation and a plan view, respectively, of a further embodiment of a connector member which is mounted flexibly relative to a scaffolding element.

DESCRIPTION OF EMBODIMENTS

Figure 1:
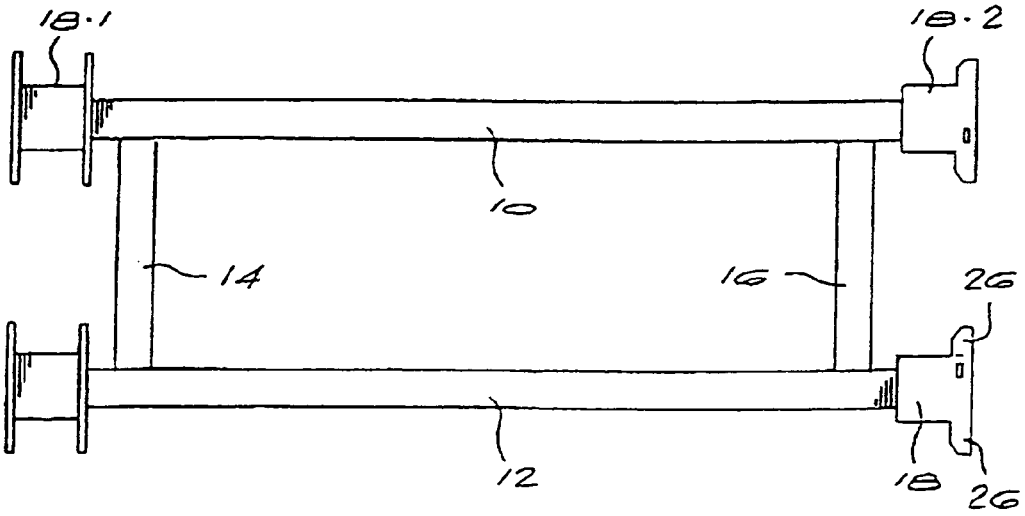
FIG. 1 is a plan view of a scaffolding element according to a first embodiment of the invention.

FIG. 1 shows a scaffolding element of the invention which is generally rectangular in shape and which comprises a pair of main members 10 and 12 joined by transverse members 14 and 16. It will be appreciated that the exact dimensions of the scaffolding member will vary according to the intended application thereof. Typically, the main members 10 and 12 are 1.2 to 4 meters long, with the auxiliary members 14 and 16 being about 0.5 to 4 meters long.

The members 10, 12, 14 and 16 are preferably formed from square section metal tubing and are welded or riveted together at their points of intersection. Preferably, the tubing is aluminium tubing, which is relatively light but sufficiently strong for the required purpose. Although the use of square section tubing is convenient, the frame members can also be formed from round section tubing or other suitable profiles, and can be formed from steel or other materials instead of aluminium.

Figure 5:
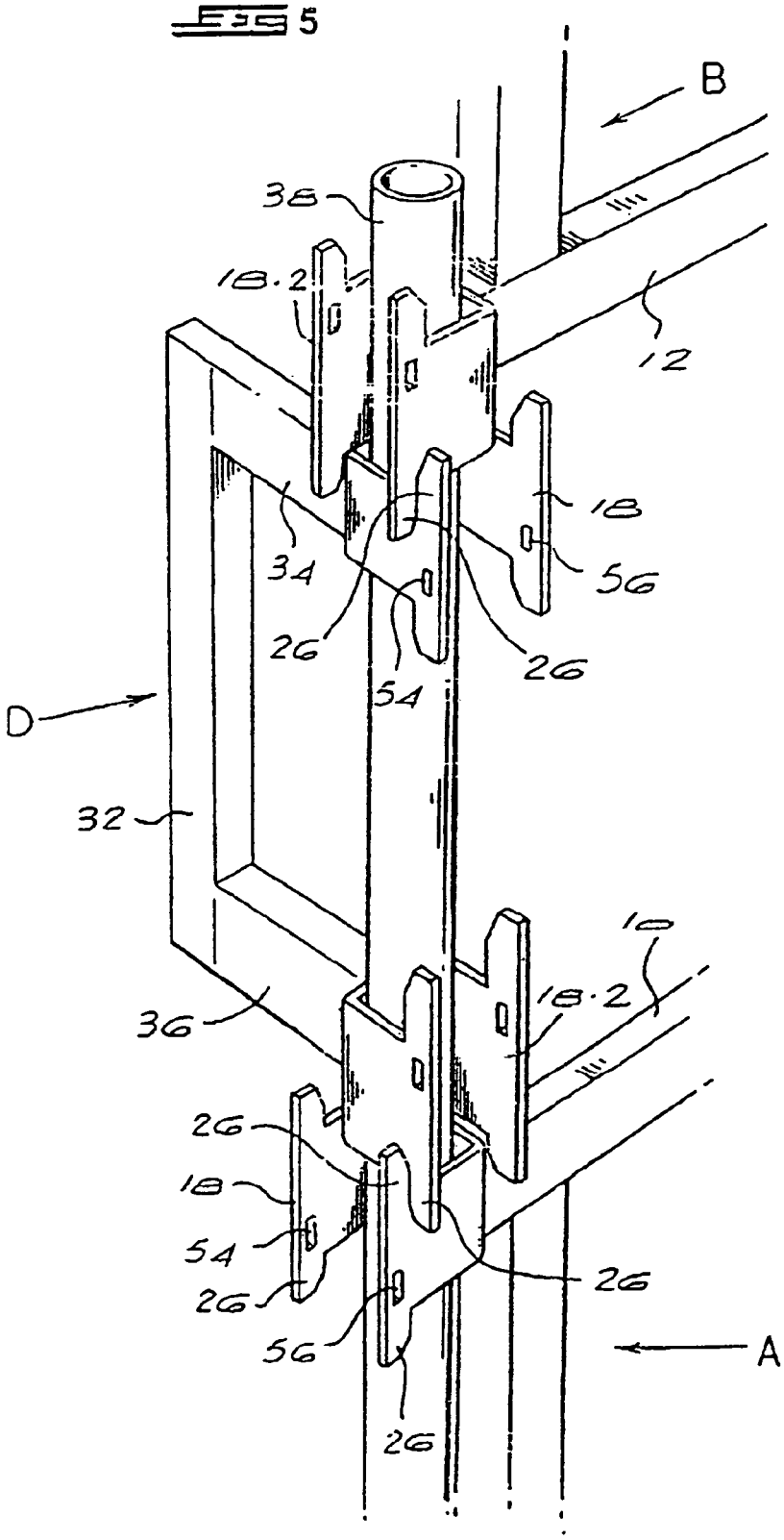
FIG. 5 is a pictorial view showing the interlocking of the scaffolding elements of FIGS. 1 and 2 in use.

At the opposed ends of each of the main frame members 10 and 12 are connector members 18.1 and 18.2 which are designed to interlock with connector members of another frame in use, as described below As best seen in FIG. 5, each connector member 18.1 and 18.2 is formed from a single blank of steel plate bent into a U shape, with a base section 20 and parallel limbs 22 and 24. At the ends of the limbs 22 and 24 remote from the base 20 are pairs of lugs 26 which are shaped with beveled corners 28, which interlock with the lugs of adjacent connector members as described below.

The connector member 18.1 is formed with a pair of parallel limbs 30*a* and 30*b* which extend from the upper and lower edges of the limb 22, and which are sized to be received in the open ends of the main frame members 10 or 12 and to be fixed in position, for example, by welding, bolting or riveting. In the case of the connector member

18.2, the limbs 30*a* and 30*b* extend from the upper and lower edges of the base section 20 of the connector member, as shown in FIG. 6.

Figure 3A:
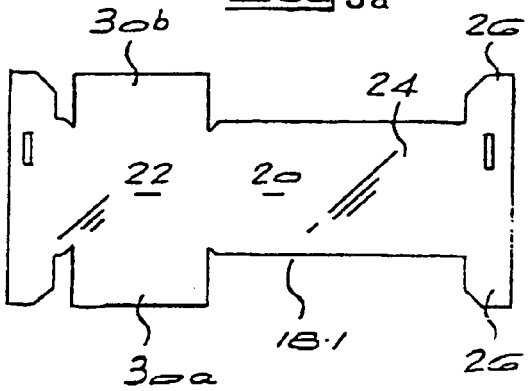
FIGS. 3*a* & 3*b* are plan views of blanks used to form connector members of the illustrated scaffolding elements.
Figure 3B:
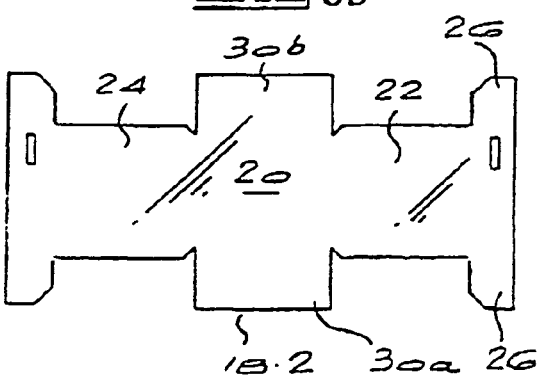

The connector members 18.1 and 18.2 are formed from the blanks shown in FIGS. 3*a* and 3*b*. The blanks are cut from steel plate and bent into the required shape. In FIGS. 3*a* and 3*b*, portions of the blanks are numbered according to the above described parts of the connector members.

Because of the fact that the connecting limbs 30*a* and 30*b* are formed either on the base of the connector member or one side limb thereof, the connector members 18.1 and 18.2 are orientated at 90° relative to one another when fixed to a main frame member 10 or 12. The reason for this is explained below.

Figure 2:
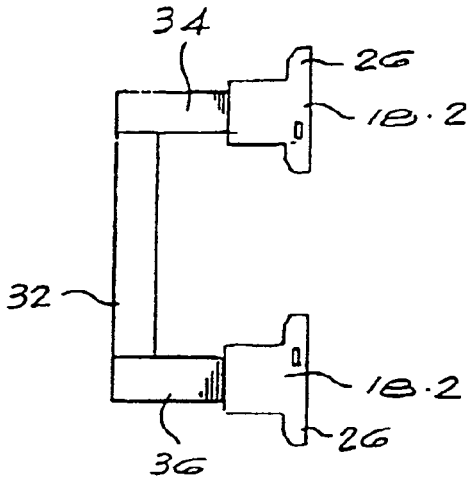
FIG. 2 is a plan view of an auxiliary scaffolding element according to the first embodiment of the invention.

FIG. 2 shows an auxiliary frame element forming part of the scaffolding system of the invention. The auxiliary frame element has an upright member 32 of the same length as the transverse frame members 14 and 16 in FIG. 1, and a pair of short transverse members 34 and 36 extending at right angles to the upright member 32, so that the auxiliary frame element has a generally C-shape. Connector members 18.2 are fixed to the free ends of the members 34 and 36 in the same manner as to the frame members 10 and 12.

Figure 4:
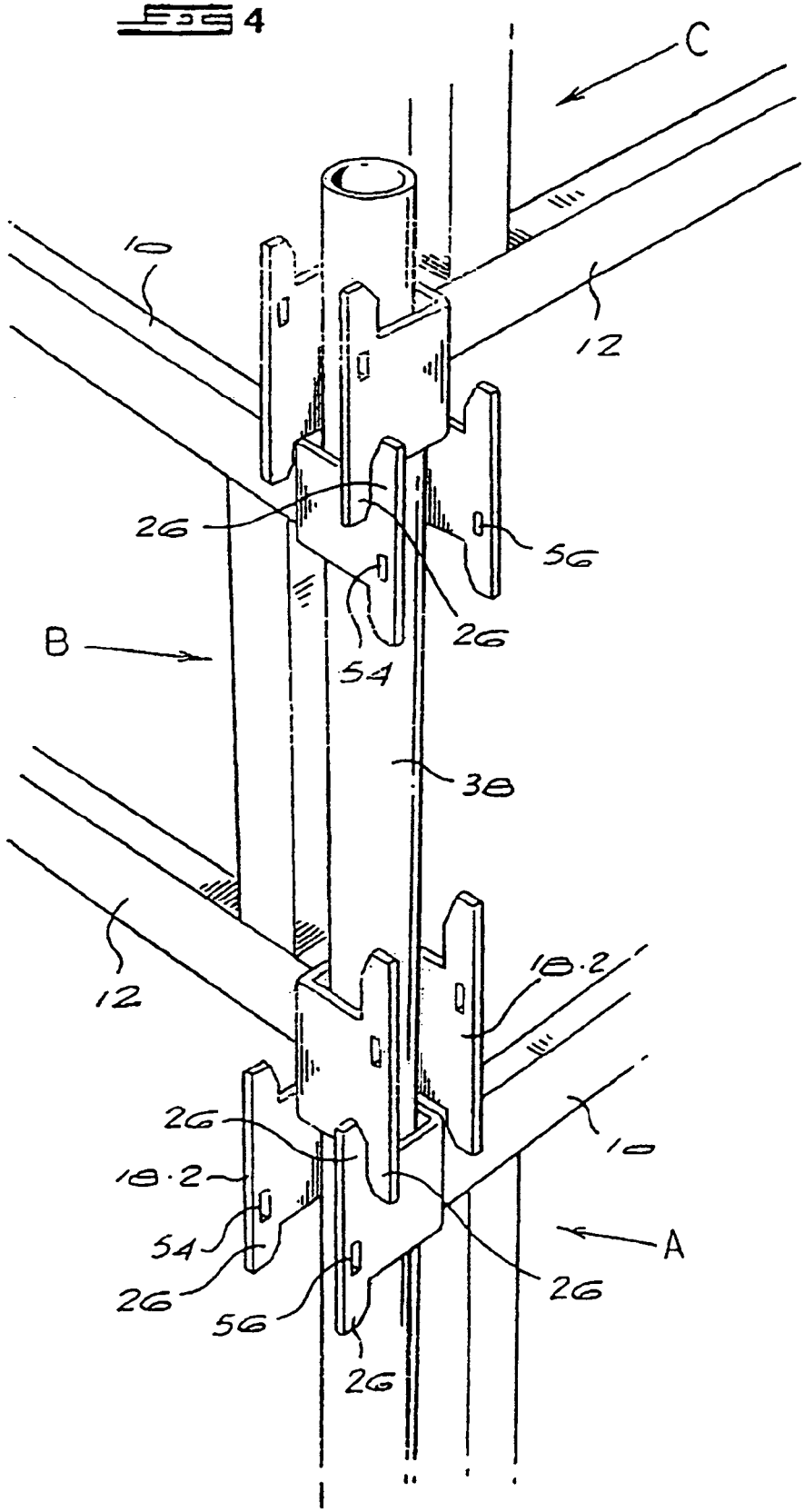
FIG. 4 is a pictorial view showing how the scaffolding elements of FIG. 1 interlock in use.

FIG. 4 illustrates how the scaffolding elements are utilized. An upright support in the form of a steel pole 38 or the like is used as a guide, and successive scaffolding elements A, B and C are stacked one on top of the other, with adjacent elements being at right angles to one another, with their connector members 18.2 embracing the pole 38 as shown, and with the limbs of the adjacent connector members abutting so that lugs 26 at the outer corners of the interlocked connector members overlap as shown.

When the connector members 18.2 at one end of a scaffolding element have been engaged with the pole 38, the scaffolding element can then be pivoted relative to the pole until the open ends of the connector members 18.1 at the other end of the scaffolding element engage a suitably spaced second pole and can then be lowered into position on top of a previous scaffolding element. This makes the scaffolding relatively easy to assemble.

With the connector members interlocked as shown, an increased load on the scaffolding thus erected tends to secure the connector members even more securely to one another, so that it will in many cases not be necessary to lock the connector members together. Also, since the interfacing parts of the scaffolding elements are the steel connector members, the aluminium tubing thereof is not subjected to damage by conventional fasteners or connectors, and loads transferred between the connector members and the tubes to which they are fastened are borne largely by the pipe sections 30 and not by the welds, rivets or bolts holding the connector members to the tubing.

In certain situations, it will not be desired to have full size scaffolding elements extending at 90° to one another as shown in FIG. 4, and it may be instead required merely to erect a relatively "flat" scaffold, in which case the auxiliary scaffolding elements of FIG. 2 can be utilized. In this case, between each main scaffolding element A and B auxiliary scaffolding elements D are interposed, as shown in FIG. 5.

FIG. 7 shows a pair of locking elements which can be used when required for additional security. Firstly, a T-shaped locking plate 40, with a transversely extending flange 42 at the base of the T, is formed from steel plate of the same gauge as that used to manufacture the connector members 18. A threaded aperture 44 in the centre of the plate 40 receives a bolt 46. As seen in FIG. 8, the locking plate 40 can be fitted into the cavity defined by the limbs 22 and 24 of a connector member 18, with the tabs 48 and 50 of the plate being seated against the inner edges of the lugs 26 of the connector member. A tapered wedge 52 is driven into opposed apertures 54 and 56 provided in the limbs 22 and 24, and the bolt 46 can be tightened to lock the connector member against the pole 38.

Figure 9:
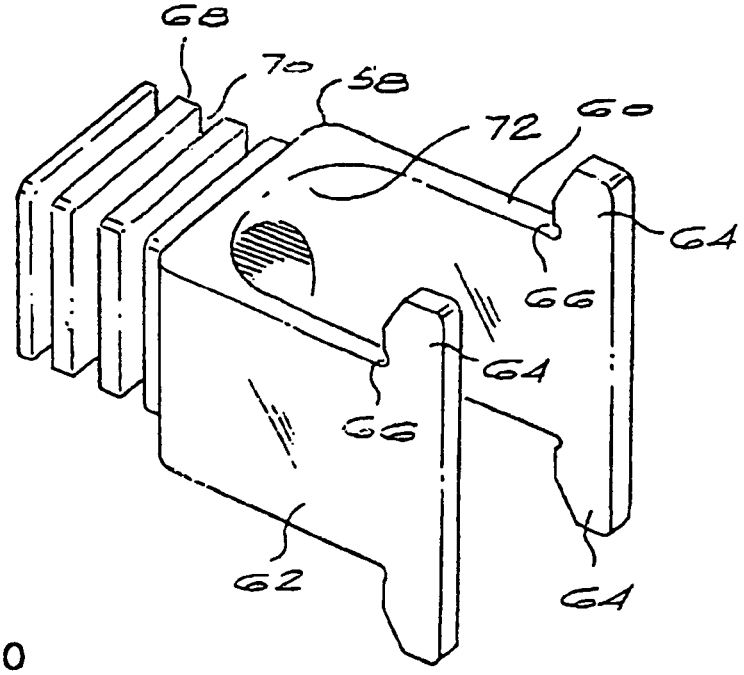
FIG. 9 is a pictorial view of an alternative, cast connector member.

FIGS. 9 to 15 show a number of variations or alternative embodiments of the invention. FIG. 9 shows an alternative connector member 58 which can be used in place of the connector member 18. The connector member 58 is a metal casting, typically comprising an aluminum alloy. The connector member has flat, parallel limbs 60 and 62 with respective pairs of lugs 64 at their outer ends. Part circular indentations 66 are defined between the lugs 64 and the respective edges of the arms 60 and 62, for engagement with a locking member, as is described in greater detail below.

At the end of the connecting member 58 remote from the lugs 64 is a head 68 which is formed with the spaced apart circumferential grooves 70. The head is sized to fit within a section of square metal tubing comprising the frame members of a scaffolding element, and to be secured by crimping. The grooves 70 ensure that the connector member is retained securely when the tubing is crimped about it.

Instead of the illustrated grooves, the head 68 can be formed with one or more holes or indentations, allowing the tubing to be secured to the head by the making of a corresponding indentation in the tubing when it is fitted to the head.

It can be noted that the connector member defines a U-shape when seen from above, with the base 72 of the U being curved intemally. The radius of curvature of the base 72 is chosen to correspond to the external diameter of the poles 38 used in erecting scaffolding structures, so that the connector member fits snugly about the poles in use.

Figure 10:
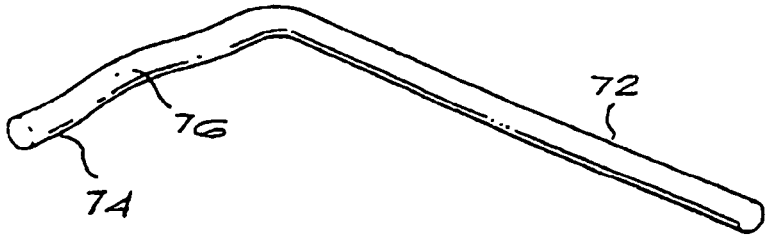
FIG. 10 is a pictorial view of a locking lever usable with the connector member of FIG. 8.

FIG. 10 is a pictorial view of a locking member designed to be used with the connector member of FIG. 9. The locking member is formed from round bar and is essentially L-shaped, with a lever or handle portion 72 and a foot portion 74 which is formed with a kinked central portion 76. In use, the foot portion 74 of the locking member is located between a pair of opposed lugs 64 and a pole 38, in the indentations 66 at the bases of the lugs, and then rotated so that the kinked portion 76 of the locking member bears against the pole with a cam action, thus locking the connector member firmly in place against the pole. It will be appreciated that by providing indentations in the lugs of the connector member 18, the locking member of FIG. 10 can be used with the first embodiment of the invention as well.

Figure 11:
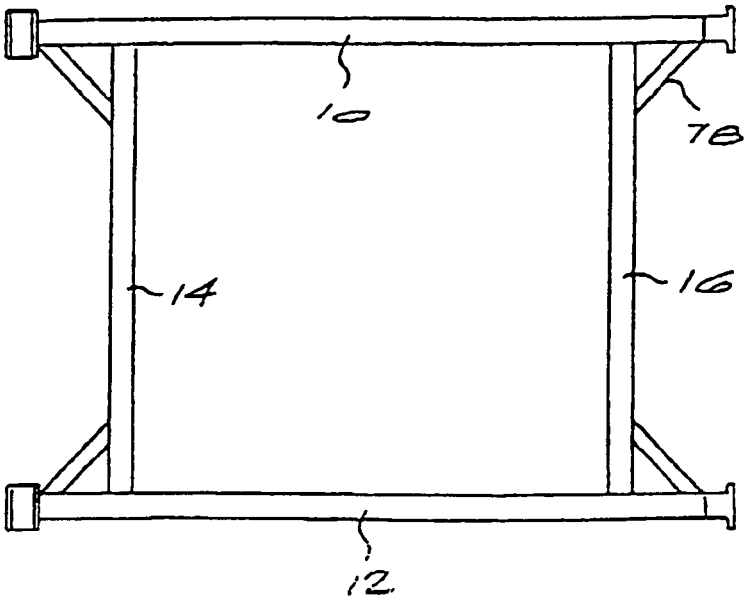
FIG. 11 is a plan view of a scaffolding element of the invention incorporating corner bracing.

FIG. 11 shows a variation of a scaffolding element in which the internal size of the frame defined by the main frame members 10 and 12 and the transverse frame members 14 and 16 is standardized, with the ends of the main frame members 10 and 12 extending substantially beyond the point of connection to the transverse frame members 14 and 16. This typically occurs when it is desired to maintain a standard internal frame dimension. In order to strengthen the scaffolding member, diagonal brace members 78 are connected between the ends of the main frame members 10 and 12 and the respective transverse frame members 14 and 16, for example, by welding.

Figure 12:
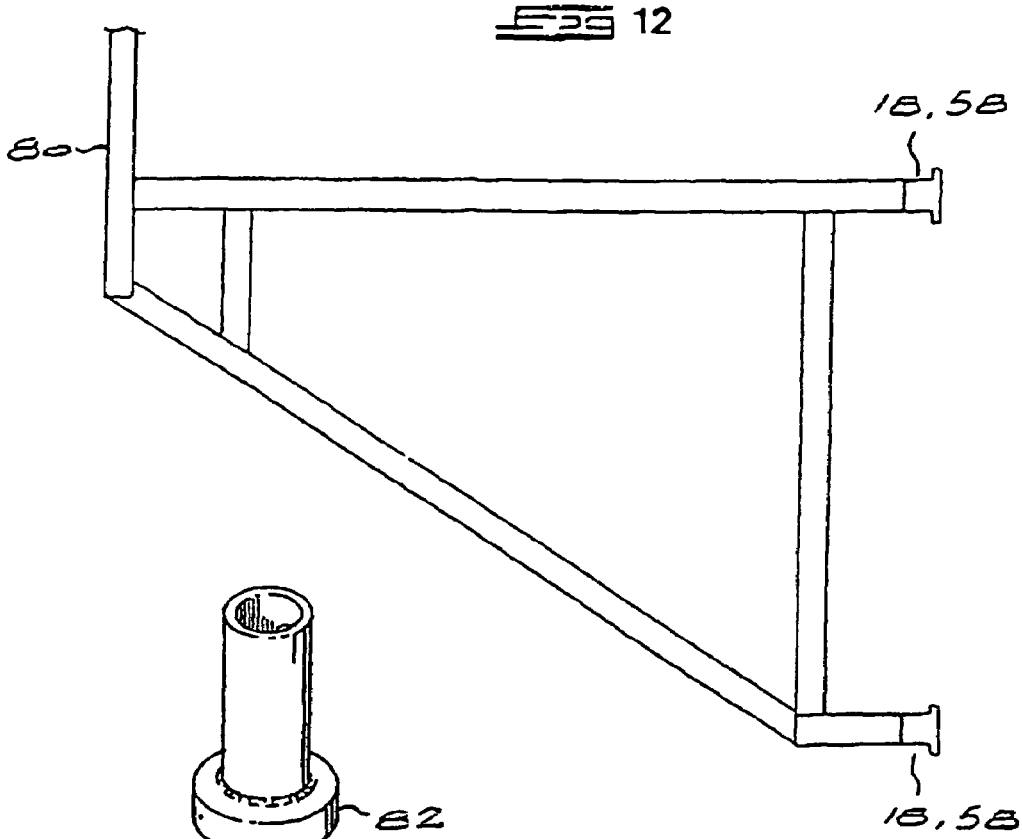
FIG. 12 is a plan view of an auxiliary scaffolding element in the form of a cantilever bracket.

FIG. 12 shows a further variation of a scaffolding element which is formed as a generally triangular bracket with a pair of transversely oriented connectors 18 or 58 and which is designed to be fitted to an edge portion of a scaffolding structure. At the end of the auxiliary scaffolding element, an upright locating pin 80 is located.

Figure 13:
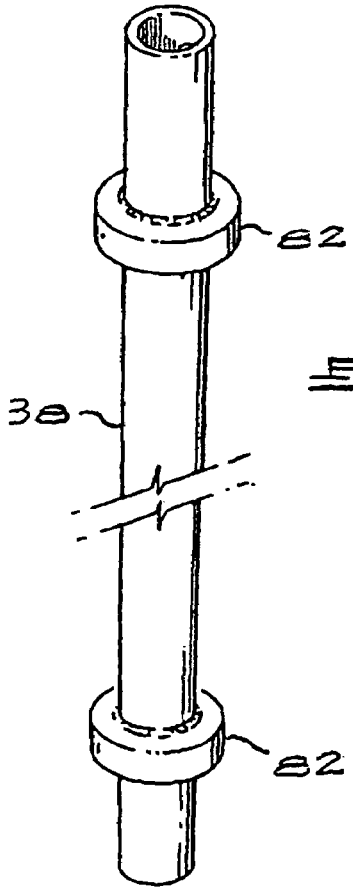
FIG. 13 shows an upright member usable with scaffolding elements of the invention, having locating rings fixed thereto at intervals.

FIG. 13 shows a variation of a steel support pole 38, to which is fitted a plurality of steel locating rings or discs 82. The discs 82 are cut from thick plate, and are fitted about the pole 38 before being welded in position. Conveniently, the rings are spaced apart by 500 mm or another standard dimension. The rings 82 are effectively an alternative to the auxiliary scaffolding element of FIG. 2, allowing scaffolding elements to be located on selected rings, rather than requiring them to be spaced by an auxiliary scaffolding element. An implication of the use of this feature is that the poles 38 become load bearing, since the load of scaffolding resting on the ring 82 is now taken by the pole 38, rather than by other scaffolding elements which fit loosely about the poles.

Figure 14:
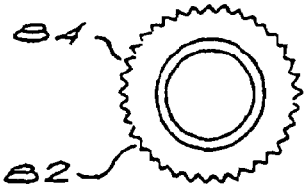
FIG. 14 is a plan view of an alternative locating ring for the upright member of FIG. 13.

FIG. 14 shows a variation of the ring 82 which is provided with teeth or grooves 84 about its periphery. The outer diameter of the ring is selected so that the lugs 26 or 64 of the connector members locate in the grooves (or between adjacent teeth), allowing a scaffolding element to be oriented securely in a desired orientation about the pole 38.

Finally, FIGS. 15*a* and 15*b* show an embodiment of a connector element which is mounted flexibly to a frame member of a scaffolding element, thus making it possible to accommodate a degree of misalignment which may develop as the scaffolding is constructed. The connector element 86 in this embodiment is attached to the frame member 88 by means of a pin 90 which passes through aligned holes in the frame member and in the head 92 of the connector element. A pair of rubber blocks 94 are inserted between the head 92 of the connector element 86 and the inner walls of the frame member 88, on either side of the head, to hold the connector member in position resiliently.

It will be appreciated that assembly of the described scaffolding elements is relatively quick and simple, due to the interlocking nature of the connector members 18 and 58. The use of upright poles 38 facilitates the assembly of the scaffolding elements, but the poles themselves are not load bearing except in the case of the pole shown in FIG. 13. Another advantage of the described arrangement is that, due to the fact that the main structural members of the scaffolding elements do not have connections made to them directly, but only via the interlocking connector members 18, damage to the frame members is reduced.

Another advantage of the described scaffolding system is that it is possible to erect it from the bottom up. Once a first set of frames have been assembled about their respective poles 38, the assembled scaffolding can be lifted, either manually or by means of jacks, for example, and a second set of scaffolding can be assembled beneath the first set. The first set is then lowered onto the second set so that the connector members thereof can engage. This process can be repeated as necessary.

Where necessary, the use of diagonal bracing between opposed scaffolding elements can be catered for, for example, by providing apertures at respective ends of the main frame members for receiving locking pins which hold diagonal bracing elements in position on the scaffolding. In many cases this will not be necessary, due to the firm interlocking between the scaffolding elements of the invention.

Finally, the scaffolding system is largely compatible with existing scaffolding systems and can be used together with conventional scaffolding.

What is claimed is:

1. A scaffolding element mountable with respect to at least one upright alignment member, the scaffolding element comprising:

at least one main member having a first end portion and a second end portion;

a first connector member connected with respect to the first end portion, and having a first section and a second section positionable about the upright alignment member, a first connecting portion extending from an upper edge portion of the first section and a second connecting portion extending from a lower edge portion of the first section, each of the first connecting portion and the second connecting portion receivable within an opening formed at the first end portion of the main member;

a second connector member connected with respect to the second end portion, and having a base section forming a first connecting portion extending from an upper edge portion of the base section and a second connecting portion extending from a lower edge portion of the base section, each of the first connecting portion and the second connecting portion receivable within an opening formed at the second end portion of the main member, the first connector member engageable with a second connector member of a second scaffolding element and the second connector member engageable with a first connector member of a third scaffolding element; and a locking element connectable to each of the first connector member and the second connector member, the locking element including a locking plate forming opposing tabs seatable with respect to at least one lug formed by at least one of the first connector member and the second connector member; a tapered wedge positionable within at least one aperture formed by the locking plate; and a bolt threadedly connected to the locking plate.

2. A scaffolding element according to claim 1 further comprising at least one transverse frame member connecting a second main member to the first main member.

3. A scaffolding element according to claim 1 wherein the first connector member is oriented at about 90° relative to the second connector member of the second scaffolding element.

* * * * *